US009785108B1

(12) United States Patent
Yuan

(10) Patent No.: US 9,785,108 B1
(45) Date of Patent: Oct. 10, 2017

(54) IMAGE FORMING APPARATUS

(71) Applicant: FUJI XEROX CO., LTD., Tokyo (JP)

(72) Inventor: Lei Yuan, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/232,415

(22) Filed: Aug. 9, 2016

(30) Foreign Application Priority Data

Mar. 15, 2016 (JP) ..... 2016-050466

(51) Int. Cl.
*G03G 21/16* (2006.01)

(52) U.S. Cl.
CPC ..... *G03G 21/1647* (2013.01)

(58) Field of Classification Search
CPC ..... G03G 21/1647
USPC ..... 399/110
See application file for complete search history.

(56) References Cited

U.S. PATENT DOCUMENTS

2017/0003648 A1* 1/2017 Arata ..... G03G 21/206

FOREIGN PATENT DOCUMENTS

JP 04269767 A * 9/1992
JP 2010-191326 A 9/2010
JP 2011-008286 A 1/2011

* cited by examiner

*Primary Examiner* — Susan Lee
(74) *Attorney, Agent, or Firm* — Sughrue Mion, PLLC

(57) ABSTRACT

An image forming apparatus includes a first removable member that includes an image carrying member and that is removably supported with respect to a body of the image forming apparatus; a first guide portion that is provided at a lower surface of the first removable member; a second guide portion that is provided at the first removable member; a first guiding portion that is provided at the body of the image forming apparatus and supports the first guide portion when the first removable member is placed on the first guiding portion; and a second guiding portion that is provided at the body of the image forming apparatus, in which, when the first removable member moves in a mounting direction from a state in which the first guide portion is supported by the first guiding portion, the second guiding portion contacts the second guide portion and guides the second guide portion.

4 Claims, 6 Drawing Sheets

IMAGE FORMING APPARATUS

CROSS-REFERENCE TO RELATED APPLICATIONS

This application is based on and claims priority under 35 USC 119 from Japanese Patent Application No. 2016-050466 filed Mar. 15, 2016.

BACKGROUND

Technical Field

The present invention relates to an image forming apparatus.

SUMMARY

According to an aspect of the invention, there is provided an image forming apparatus including a first removable member that includes an image carrying member and that is removably supported with respect to a body of the image forming apparatus; a first guide portion that is provided at a lower surface of the first removable member; a second guide portion that is provided at the first removable member; a first guiding portion that is provided at the body of the image forming apparatus and that supports the first guide portion when the first removable member is placed on the first guiding portion; and a second guiding portion that is provided at the body of the image forming apparatus, in which, when the first removable member moves in a mounting direction from a state in which the first guide portion is supported by the first guiding portion, the second guiding portion contacts the second guide portion and guides the second guide portion.

BRIEF DESCRIPTION OF THE DRAWINGS

An exemplary embodiment of the present invention will be described in detail based on the following figures, wherein.

DETAILED DESCRIPTION

Figure 1:
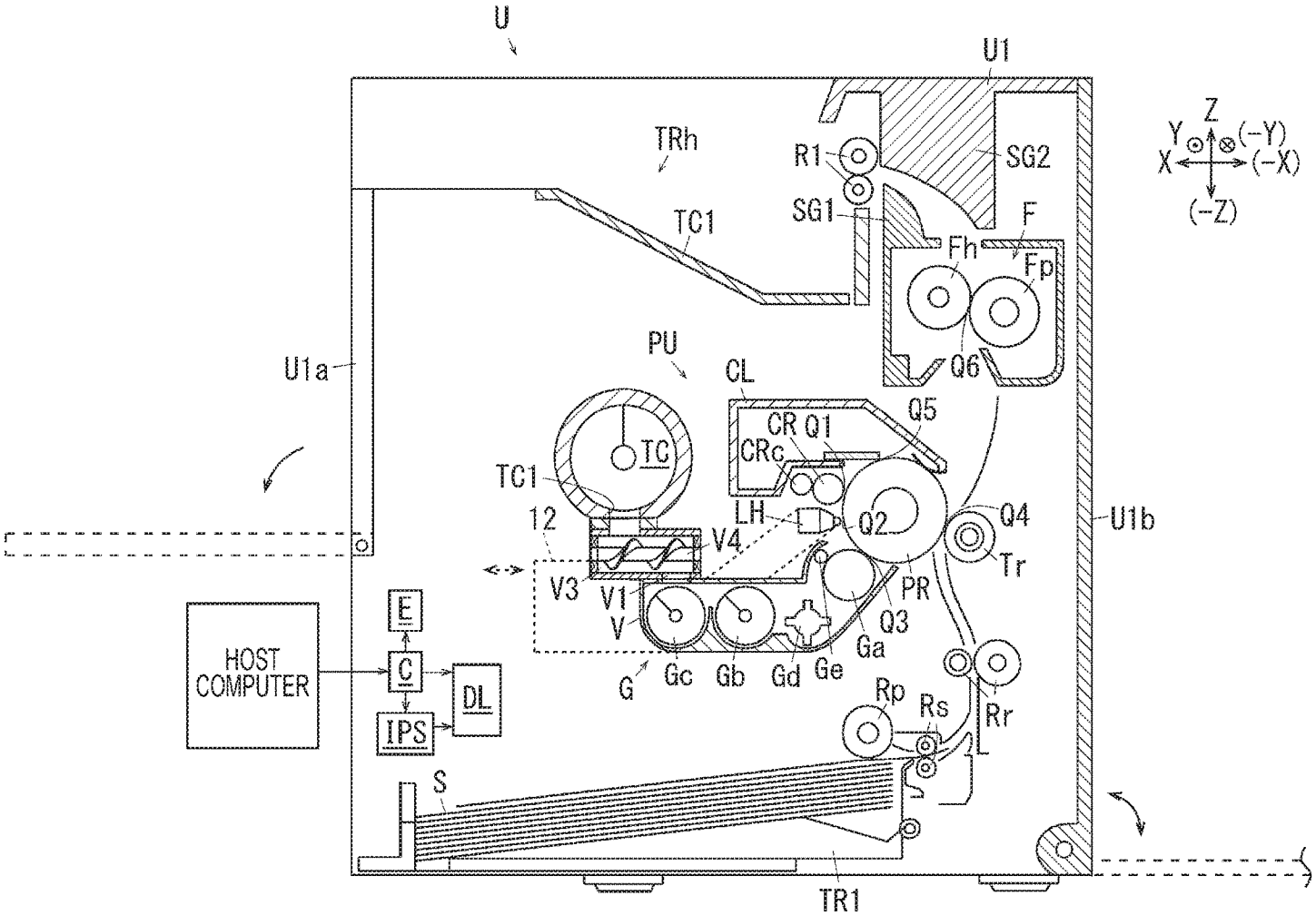
FIG. 1 is an explanatory view of the entire image forming apparatus according to an exemplary embodiment.

Next, an exemplary embodiment of the present invention is described with reference to the drawings. However, the present invention is not limited to the following exemplary embodiment.

To facilitate understanding of the following description, in the drawings, a front-rear direction is defined as an x axis direction, a left-right direction is defined as a y axis direction, and an up-down direction is defined as a z axis direction. The directions or sides that are denoted by arrows X, −X, Y, −Y, Z, and −Z correspond to a forward direction, a rearward direction, a rightward direction, a leftward direction, an upward direction, and a downward direction, or to a front side, a rear side, a right side, a left side, an upper side, and a lower side.

In the drawings, a circle with a dot in the center signifies an arrow extending from rear to front in the plane of the drawings, whereas a circle with an x in the center signifies an arrow extending from front to rear in the plane of the drawings.

In the description that refers to the drawings below, members other than those required for facilitating understanding of the description are not shown as appropriate.

Exemplary Embodiment

FIG. 1 is an explanatory view of the entire image forming apparatus according to the exemplary embodiment.

In FIG. 1, in a printer U, which is an exemplary image forming apparatus according to the exemplary embodiment of the present invention, a front cover U1*a*, which is an exemplary opening/closing member, is supported at a front surface of a printer body U1, which is an exemplary image forming apparatus body. The front cover U1*a* is openably and closably supported around a rotation center. A discharge tray TRh, which is an exemplary discharge section, is formed at an upper surface of the printer U. Further, a rear cover U1*b*, which is an exemplary opening/closing member, is rotatably supported at a rear surface of the printer body U1. The rear cover U1*b* is supported so as to be rotatable between a closing position, which is denoted by a solid line, and an open position, which is denoted by a broken line. When, for example, checking whether or not sheet jamming has occurred at the rear cover U1*b*, which is an exemplary opening/closing member, or checking the inside of the image forming apparatus, the rear cover U1*b* allows the rear side of the printer body U1 to be uncovered.

The printer U according to the exemplary embodiment includes a controller C, which is an exemplary controller. An image processing section IPS; a laser drive circuit DL, which is an exemplary latent image formation circuit; and a power supply circuit E are electrically connected to the controller C. Therefore, the controller C is capable of outputting a control signal to, for example, the image processing section IPS.

A photoconductor PR, which is an exemplary image carrying member that is rotationally driven, is supported at a rear portion of the printer U. A charging roller CR, a latent image forming device LH, a developing device G, a transfer roller Tr, and a photoconductor cleaner CL are disposed around the photoconductor PR along the direction of rotation of the photoconductor PR. The photoconductor PR is also an exemplary rotary member. The transfer roller Tr is an exemplary transfer member. The photoconductor cleaner CL is an exemplary cleaning unit for the image carrying member.

In FIG. 1, a charging roller cleaner CRc, which is an exemplary cleaning unit for a charging device, is disposed so as to oppose and contact the charging roller CR.

The latent image forming device LH includes a so-called LED head, which is a device in which light emitting diodes (LEDs), which are exemplary latent image writing elements, are linearly disposed apart from each other at preset intervals along the left-right direction.

The developing device G includes a developing container V containing developer therein. A developing roller Ga, which is an exemplary developer holding member, is disposed in the developing container V so as to oppose the photoconductor PR. A pair of circulating transporting members Gc and Gb and a supplying member Gd are disposed with decreasing distance from the developing roller Ga in the developing container V. A layer thickness regulating member Ge is disposed in the developing container V so as to oppose the developing roller Ga.

A developer supply port V1, which is an exemplary supplying section, is formed in an upper surface of the front side of the developing container V. A developer supply path V3, which is an exemplary developer transport path, communicates with the developer supply port V1. The developer supply path V3 has a cylindrical shape extending towards the front. A supply auger V4, which is an exemplary developer transport member, is rotatably supported in the developer supply path V3. A toner cartridge TC, which is an exemplary developer container, is removably supported at a front end of the developer supply path V3. The toner cartridge TC has an outlet TC1, and has a structure that allows developer to flow into the developer supply path V3 from the toner cartridge TC.

In FIG. 1, a sheet-feed tray TR1, which is an exemplary medium accommodating section, is disposed at a lower portion of the printer U. A pickup roller Rp, which is an exemplary medium take-out member, is disposed at a rear portion of the sheet-feed tray TR1. Separating rollers Rs, which are exemplary medium separating members, are disposed behind the pickup roller Rp. Registration rollers Rr, which are exemplary time adjusting members, are disposed above the separating rollers Rs.

A fixing device F is disposed above a transfer region Q4 where the photoconductor PR and the transfer roller Tr oppose each other. The fixing device F includes a pair of fixing rollers Fh and Fp, which are exemplary fixing members. A press-contact region between the pair of fixing rollers Fh and Fp define a fixing region Q6.

Sheet guides SG1 and SG2, which are exemplary medium guiding members, are disposed above the fixing device F. Discharge rollers R1, which are exemplary discharging members, are disposed in front of the sheet guides SG1 and SG2.

Description of Image Forming Operation

Print information is transmitted to the controller C of the printer U from, for example, a host computer, which is an exemplary external information transmitting device. When the controller C receives the print information, an image forming operation is started. The controller C outputs the print information to the image processing section IPS. The image processing section IPS converts the print information into latent-image-formation image information, and outputs the image information at a preset time, that is, timing to the laser drive circuit DL, which is an exemplary image writing circuit. The laser drive circuit DL outputs a driving signal to the latent image forming device LH in accordance with the input image information.

When the image forming operation is started, the photoconductor PR starts rotating.

A charging voltage is applied to the charging roller CR from the power supply circuit E. In a charging region Q1 where the charging roller CR and the photoconductor PR oppose each other, the charging roller CR charges the surface of the photoconductor PR.

The charging roller cleaner CRc cleans the surface of the charging roller CR.

The latent image forming device LH forms, in a writing region Q2, an electrostatic latent image that is in accordance with the image information on the surface of the photoconductor PR.

In the developing device G, the pair of circulating transporting members Gc and Gb circulate and transport developer while mixing the developer in the developing container V. The supplying member Gd transports the developer that has been mixed by the circulating transporting members Gb and Gc to the developing roller Ga. The thickness of the developer on the surface of the developing roller Ga is regulated when the developer passes through a region where the developing roller Ga and the layer thickness regulating member Ge oppose each other. A development voltage is applied to the developing roller Ga from the power supply circuit E. In a developing region Q3 where the developing roller Ga and the photoconductor PR oppose each other, the electrostatic latent image on the photoconductor PR is developed into a visible image by the developer on the developing roller Ga.

In accordance with the amount of consumption of the developer at the developing device G, the supply auger V4 is driven to supply developer to the developing device G from the toner cartridge TC.

The pickup roller Rp sends out a recording sheet S accommodated in the sheet-feed tray TR1.

When the pickup roller Rp has sent out multiple recording sheets S, the separating rollers Rs separate the recording sheets S one sheet at a time. The recording sheets S that have been separated one sheet at a time by the separating rollers Rs are sent to the registration rollers Rr. The registration rollers Rr transport the recording sheets S to the transfer region Q4 at a preset timing.

A transfer voltage is applied to the transfer roller Tr from the power supply circuit E. The transfer roller Tr transfers a toner image on the photoconductor PR to the recording sheet S that passes through the transfer region Q4.

In a cleaning region Q5, which is an exemplary cleaning region that has been provided downstream from the transfer region Q4, the photoconductor cleaner CL removes any residual toner on the surface of the photoconductor PR.

The recording sheet S to which the toner image has been transferred in the transfer region Q4 is transported to the fixing device F with the toner image being unfixed.

In the fixing device F, the fixing region Q6 is defined by the press-contact region between the fixing rollers Fh and Fp. The toner image on the recording sheet S that has been transported to the fixing device F is fixed thereto in the fixing region Q6 by the pair of fixing rollers Fh and Fp.

The recording sheet S to which the toner image has been fixed is guided by the sheet guides SG1 and SG2.

The discharge rollers R1 discharge the recording sheet S onto the discharge tray TRh.

Description of Attaching-Detaching Structure of Process Cartridge

Figure 2:
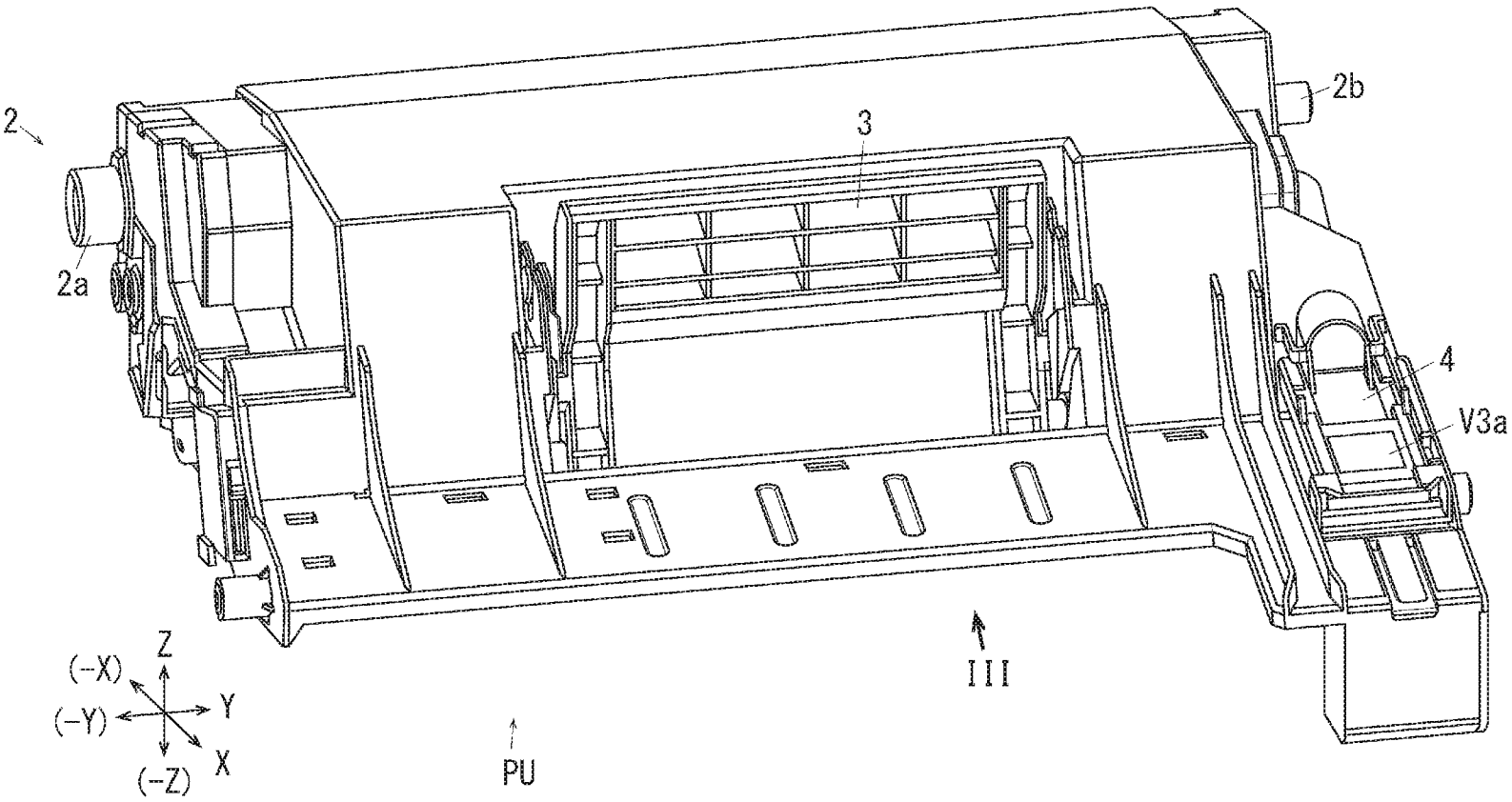
FIG. 2 is an enlarged view of a process cartridge according to the exemplary embodiment.

FIG. 2 is an enlarged view of a process cartridge PU according to the exemplary embodiment.

Figure 3:
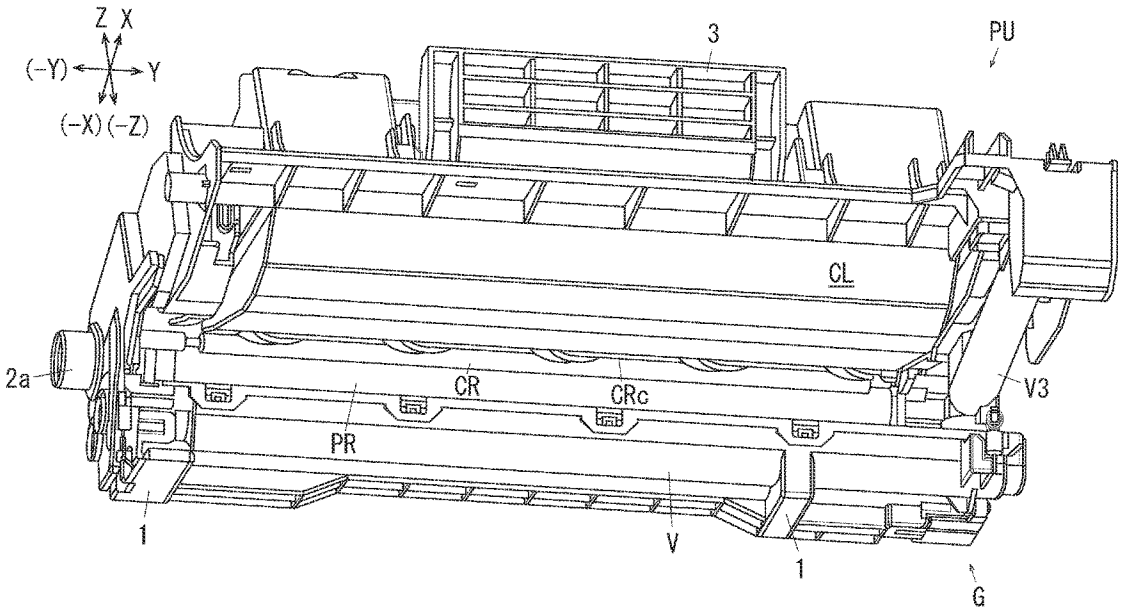
FIG. 3 illustrates the process cartridge as seen from the direction of arrow III in FIG. 2.

FIG. 3 illustrates the process cartridge as seen from the direction of arrow III in FIG. 2.

In FIGS. 1 to 3, in the exemplary embodiment, the photoconductor PR, the charging roller CR, the charging roller cleaner CRc, the latent image forming device LH, the developing device G, the photoconductor cleaner CL, the developer supply path V3, the supply auger V4, etc., constitute the process unit PU, which is an exemplary first removable member. Therefore, the process unit PU is removable as a unit from the printer body U1.

In FIG. 3, in the process unit PU according to the exemplary embodiment, guide protrusions 1, which are exemplary first guide portions, are formed at a bottom surface of the developing container V, which is a bottom portion of the process unit PU. A pair of the guide protrusions 1 according to the exemplary embodiment are formed, one on the left side and one on the right side of the process unit PU. The guide protrusions 1 according to the exemplary embodiment are formed as protruding portions that protrude downward from the bottom surface of the developing container V and that extend in the front-rear direction.

In FIGS. 2 and 3, in the process unit PU according to the exemplary embodiment, photoconductor shafts 2, which are exemplary second guide portions, are provided. A pair of the photoconductor shafts 2 (2*a* and 2*b*) are provided, one on the left side and one on the right side of the process unit PU. The photoconductor shafts 2 protrude outward from the process unit PU in the left-right direction.

In FIGS. 2 and 3, a handle 3, which is an exemplary grip section, is provided on a front side of an upper portion of the process unit PU. The handle 3 is usable when a user attaches or detaches the process unit PU. A shutter 4, which is an exemplary opening-closing member for an inlet, is disposed on a front side of a right portion of the process unit PU. The shutter 4 is capable of covering and uncovering an inlet V3*a* of the developer supply path V3.

Figure 4:
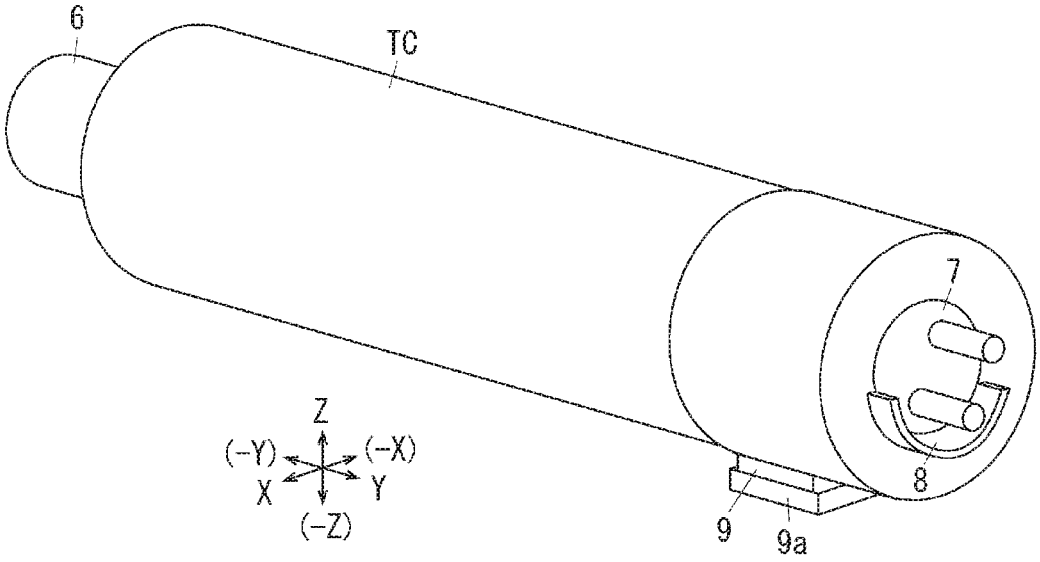
FIG. 4 is an explanatory view of a toner cartridge according to the exemplary embodiment.

FIG. 4 is an explanatory view of the toner cartridge TC according to the exemplary embodiment.

In FIG. 4, the toner cartridge TC, which is an exemplary second removable member, includes a guide protrusion 6, which is an exemplary third guide portion, on a left end thereof. The guide protrusion 6 has a columnar shape that protrudes leftwards. A coupling 7, which is an exemplary drive-power transmission section, is supported at a right end of the toner cartridge TC. The coupling 7 is connected to a developing transporting member (not shown) disposed in the toner cartridge TC. Therefore, the coupling 7 is formed such that, when drive power is transmitted to the coupling 7, the transporting member rotates, and developer in the toner cartridge TC is transportable towards an outlet TC1. A guide rib 8, which is an exemplary third guide portion, is formed below the coupling 7 on the right end of the toner cartridge TC.

An outlet section 9 including the outlet TC1 is formed at a lower end of the right side of the toner cartridge TC. A shutter 9*a*, which is an exemplary opening-closing member for the outlet TC1, is supported at the outlet section 9. When the toner cartridge TC is to be mounted on the printer body U1, the shutters 4 and 9*a* are opened, and the outlet TC1 and the inlet V3*a* communicate with each other.

Figure 5:
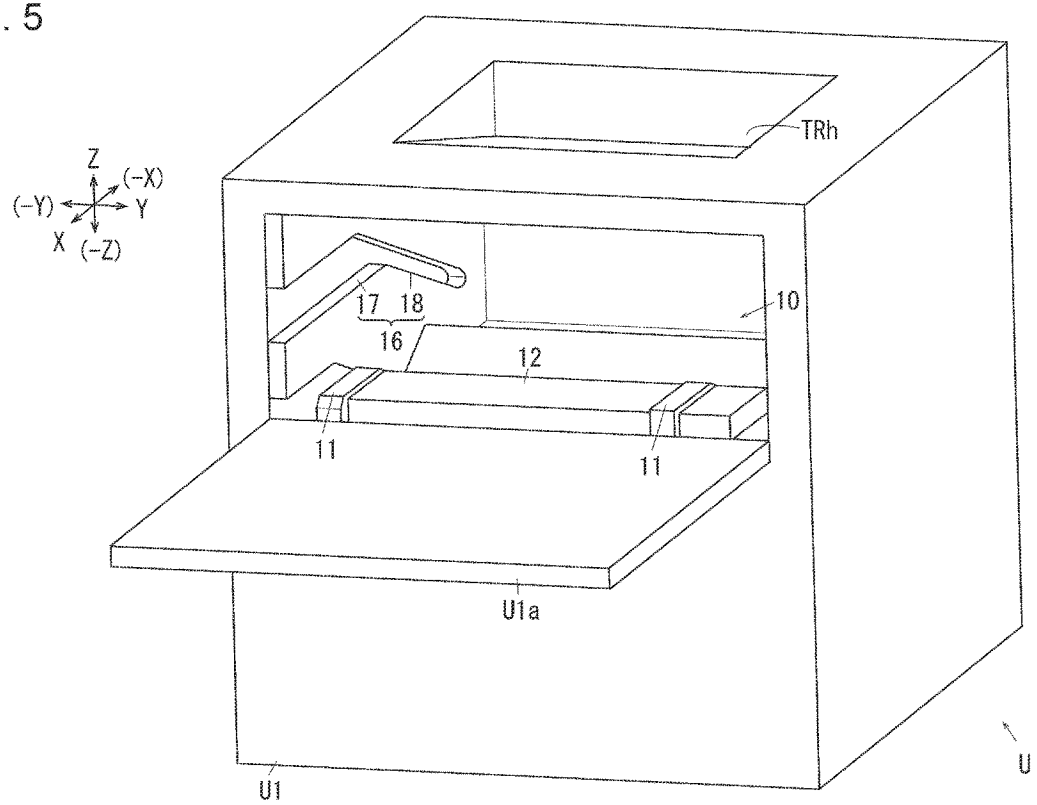
FIG. 5 is an explanatory view of a left guiding portion of a body of the image forming apparatus according to the exemplary embodiment.

FIG. 5 is an explanatory view of a left guiding portion of the body of the image forming apparatus according to the exemplary embodiment.

Figure 6:
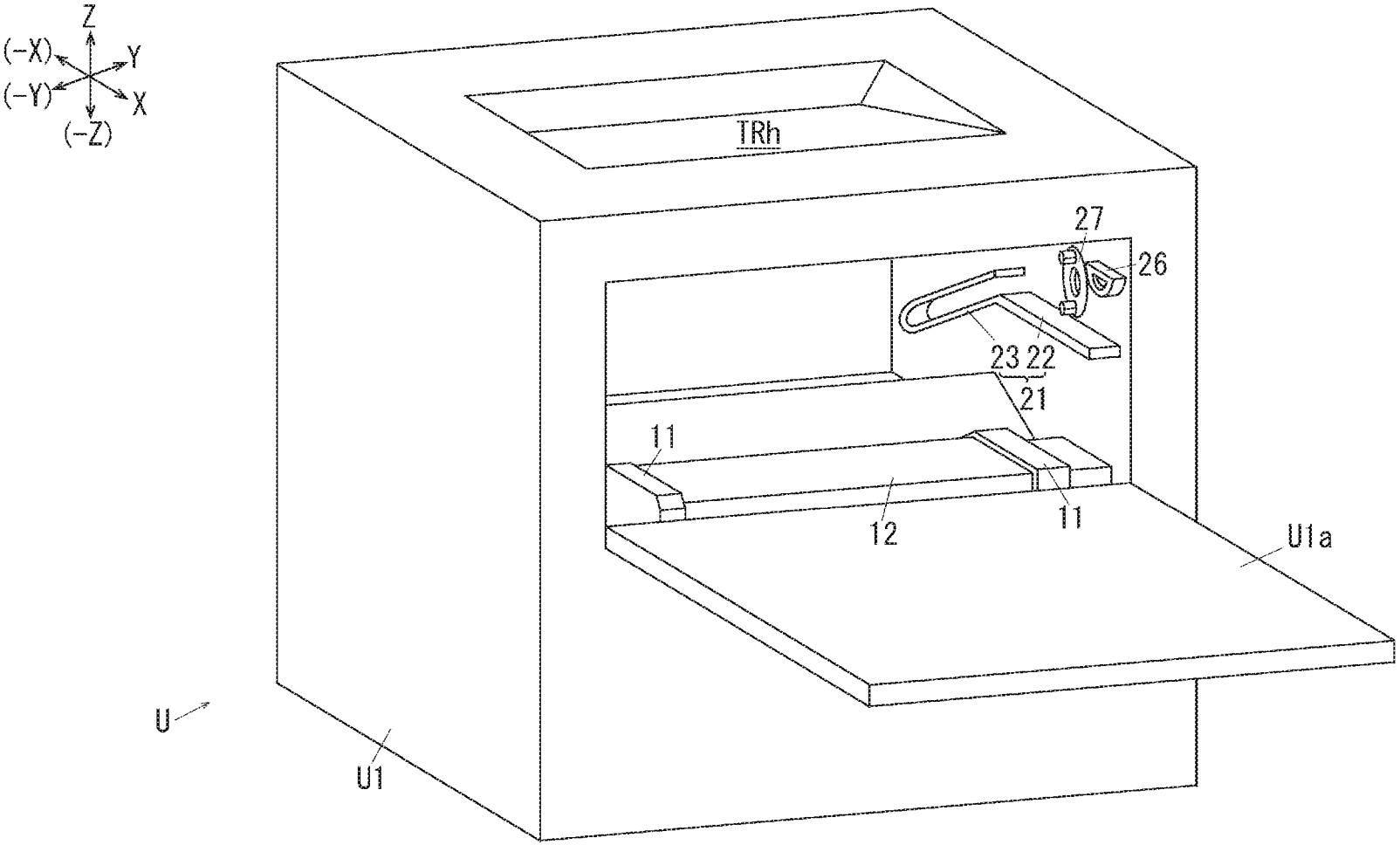
FIG. 6 is an explanatory view of a right guiding portion of the body of the image forming apparatus according to the exemplary embodiment.

FIG. 6 is an explanatory view of a right guiding portion of the body of the image forming apparatus according to the exemplary embodiment.

In FIGS. 5 and 6, an accommodation space 10, which is an exemplary accommodating section that removably accommodates the process unit PU, is formed at an inner side of the front cover U1*a* of the printer body U1. Bases 11, which are exemplary first guiding portions, are provided at a lower portion of a front side of the accommodation space 10. The bases 11 according to the exemplary embodiment are formed so as to protrude upward from an upper surface of a writing unit 12 including the latent image forming device LH. By a linking mechanism (not shown), the writing unit 12 according to the exemplary embodiment is movable in the front-rear direction (in the direction of an arrow to a location indicated by dotted lines in FIG. 1) in response to an opening and a closing operation of the front cover U1*a*. Therefore, when the front cover U1*a* is opened, the writing unit 12 moves towards the front (near side), and the latent image forming device LH moves away from the photoconductor PR. When the front cover U1*a* is closed, the writing unit 12 moves towards the rear (far side), and the latent image forming device LH approaches the photoconductor PR.

A pair of the bases 11 are disposed in correspondence with the guide protrusions 1, one on the left side and one on the right side. The writing unit 12 is secured to and supported by the printer body U1. Therefore, the writing unit 12 is formed such that, when the guide protrusions 1 move onto the bases 11, the process unit PU is capable of being held on the upper surface of the writing unit 12.

In FIG. 5, a left guiding groove 16, which is an exemplary second guiding portion, is formed above the bases 11 and on the left side of the accommodation space 10. The left guiding groove 16 includes a left horizontal portion 17 extending in the front-rear direction, and a left inclined portion 18 that inclines downward towards the rear from a rear end of the left horizontal portion 17. In the exemplary embodiment, the position of the left horizontal portion 17 in the up-down direction is set in correspondence with the left photoconductor shaft 2*a* with the guide protrusions 1 in contact with the bases 11. In the exemplary embodiment, the width of the left horizontal portion 17 in the up-down direction is sufficiently greater than the outside diameter of the left photoconductor shaft 2*a*. The width of the left inclined portion 18 in the up-down direction is equivalent to the outside diameter of the left photoconductor shaft 2*a*. Therefore, the width of the left inclined portion 18 is less than the width of the left horizontal portion 17.

In the left guiding groove 16, the length of the left horizontal portion 17 in the front-rear direction and the position of a front end of the left inclined portion 18 are set such that, when the process unit PU has moved rearward, the left photoconductor shaft 2*a* reaches the front end of the left inclined portion 18 after the guide protrusions 1 have separated from the bases 11.

In the exemplary embodiment, the left horizontal portion 17 is also used as a guiding portion that guides the guide protrusion 6 of the toner cartridge TC.

In FIG. 6, a right guiding wall 21, which is an exemplary second guiding portion, is formed on the right side of the accommodation space 10. The right guiding wall 21 protrudes leftwards from a right wall of the printer body U1. The right guiding wall 21 includes a right horizontal wall 22 that extends in the front-rear direction and a right inclined wall 23 that inclines downward towards the rear from a rear end of the right horizontal wall 22. The right horizontal wall 22 according to the exemplary embodiment is formed from a wall member that is capable of guiding a lower side of the right photoconductor shaft 2*b*. The right inclined wall 23 according to the exemplary embodiment is formed so as to guide the right photoconductor shaft 2*b* with upper and lower sides of the right photoconductor shaft 2*b* being sandwiched by the right inclined wall 23. However, the width of the right inclined wall 23 is equivalent to the outside diameter of the right photoconductor shaft 2*b*. The right horizontal wall 22 is also used as a guiding portion that guides a lower surface of the guide rib 8 of the toner cartridge TC.

A coupling guide 26, which is an exemplary rotation position adjusting member, is disposed above a front side of the right horizontal wall 22. The coupling guide 26 is formed so as to protrude leftwards from a right surface. The coupling guide 26 has a semi-cylindrical shape whose upper and lower sides are inverted. The coupling guide 26 is formed such that, when, in mounting the toner cartridge TC, the rotation position of a protruding section of the coupling 7 is displaced from a preset rotation position, the coupling guide 26 comes into contact with the protruding section of the coupling 7, and the rotation position is moved to the preset rotation position.

A coupling 27, which is an exemplary drive-power transmitting section, is disposed behind the coupling guide 26. When the toner cartridge TC is mounted on the printer body U1, the coupling 27 engages with the coupling 7 of the toner cartridge TC, and is brought into a state in which drive power is capable of being transmitted. The coupling 27 is formed such that drive power is capable of being transmitted from a motor (not shown) for driving the toner cartridge TC.

Description of Attaching-Detaching Structure of Process Unit PU

In the printer U according to the exemplary embodiment having the above-described structure, when the lifetime of the photoconductor PR or the charging roller CR is reached due to wear of the photoconductor PR or wear of the charging roller CR, or when the developing device G breaks down, the process unit PU is replaced. When the process unit PU is to be replaced, the front cover U1*a* is opened, and the toner cartridge TC that is disposed at the near side is removed first. The handle 3 is operated to remove the process unit PU. When a new process unit PU is to be mounted, a user only needs to move the process unit PU onto the bases 11 to bring the bases 1 into contact with the guide protrusions 1 and to align the position of the photoconductor shaft 2*a* with the left horizontal portion 17 and the position of the photoconductor shaft 2*b* with the right horizontal wall 22. When the process unit PU is pushed in a rearward direction, which is an exemplary mounting direction, the guide protrusions 1 are guided rearwards while sliding with respect to the bases 11. When the bases 11 and the guide protrusions 1 separate from each other, the photoconductor shafts 2*a* and 2*b* are guided along the respective inclined portion 18 and right inclined portion 23 via the respective left horizontal portion 17 and right horizontal wall 22. Then, the process unit PU is moved to a rear end (furthest portion), and is mounted on the printer body U1.

As described in Japanese Unexamined Patent Application Publication No. 2011-8286 (Patent Literature 1 (PTL 1)), in the case where guiding members that protrude outwardly from left and right ends of the process unit are used, when a user is to mount the process unit on the printer body, the protrusions and grooves need to be aligned first. Aligning the positions of all of the left and right protrusions with the grooves is troublesome to carry out. In particular, when a protrusion exists at a far side in a mounting direction, it is difficult for an operator to see the protrusion. Therefore, it is difficult for the operator to confirm whether or not the protrusion has been precisely fitted into the groove, as a result of which workability is reduced. In particular, in recent years, a gap used for confirming whether or not the protrusion has been fitted tends to be narrow due to downsizing of image forming apparatuses. Therefore, it is even more difficult to confirm whether or not the protrusion has been fitted into the groove.

In contrast, in the exemplary embodiment, the photoconductor shafts 2*a* and 2*b* and the respective left horizontal portion 17 and right horizontal wall 22 are naturally aligned with each other by only moving the bottom portion of the process unit PU onto the bases 11. In addition, the photoconductor shafts 2*a* and 2*b* are naturally guided along the left inclined portion 18 and the right inclined wall 23 by only pushing the photoconductor shafts 2*a* and 2*b* to the far side of the printer U. Therefore, in the exemplary embodiment, compared to the related art described in PTL 1, workability when mounting the process unit PU may be increased.

In particular, in the exemplary embodiment, the width of the left horizontal portion 17 is greater than the outside diameter of the left photoconductor shaft 2*a*, and the right horizontal wall 22 is only provided at a lower side. That is, the left photoconductor shaft 2*a* is supported such that there is enough space with respect to the left horizontal portion 17. In the case where there is no difference between the width of the left horizontal portion 17 and the outside diameter of the left photoconductor shaft 2*a*, when the process unit PU is placed on the bases 11, the left photoconductor shaft 2*a* interferes with the left horizontal portion 17 unless the left photoconductor shaft 2*a* is aligned with respect to the left horizontal portion 17. In contrast, when there is a difference as in the exemplary embodiment, even if the process unit PU is roughly aligned with the bases 11, and placed on the bases 11, the left photoconductor shaft 2*a* is capable of being aligned with the left horizontal portion 17. Therefore, when the process unit PU is to be placed on the bases 11, it is no longer necessary to align the left photoconductor shaft 2*a* with the left horizontal portion 17, as a result of which workability when mounting the process unit PU may be increased.

Here, if the bases 11 are disposed at the same height as the left guiding groove 16 and the right guiding wall 21, the bases interfere with the mounting of the toner cartridge TC. Therefore, the toner cartridge TC is disposed even more towards the near side of the bases 11. Consequently, as a whole, the length of the printer U in the front-rear direction is increased. In contrast, in the exemplary embodiment, the height of the bases 11 differ from the heights of the left guiding groove 16 and the right guiding wall 21 in a gravitational direction. Therefore, it is possible to dispose the toner cartridge TC above the bases 11. Consequently, compared to when the bases 11 are disposed at the same height as the left guiding groove 16 and the right guiding wall 21, the size of the printer U may be reduced as a whole.

In the exemplary embodiment, the left horizontal portion 17 and the right horizontal wall 22 are also used as guides when attaching and detaching the toner cartridge TC. Therefore, compared to when members are not used in common, in the exemplary embodiment, the number of components and manufacturing costs may be reduced.

In the exemplary embodiment, the bases 11 are disposed below an entrance of the accommodation space 10. When the bases 11 are disposed above the entrance in a gravitational direction, a user needs to lift the process unit PU to the height of the bases. This is burdensome when mounting the process unit PU. In contrast, in the exemplary embodiment in which the bases 11 are disposed below the entrance, compared to when the bases are disposed above the entrance, it becomes less burdensome to mount the process unit PU, as a result of which workability may be increased.

Modifications

Although an exemplary embodiment according to the present invention is described in detail above, the present invention is not limited to the exemplary embodiment. Various modifications may be made within the scope of the gist of the present invention described in the claims. Modifications (H01) to (H06) according to the present invention are exemplified below.

(H01) Although, in the exemplary embodiment, the printer U is exemplified as an exemplary image forming apparatus, other types of image forming apparatuses may be used. The image forming apparatus may be, for example, a copying machine, a fax, or a multifunction apparatus having more than one function or all of the functions of the copying machine and the fax.

(H02) Although, in the exemplary embodiment, the printer U is exemplified as having a structure that uses a monochromatic color, other structures may be used. For example, the printer U may be an image forming apparatus that uses two or more colors.

(H03) Although, in the exemplary embodiment, the guide portions of the process unit PU are protrusions, and the guiding portions of the printer body U1 are grooves or recessed portions, the guide portions and the guiding portions are not limited thereto. For example, the process unit PU may have recessed portions, and the printer body may have protrusions. Alternatively, the shapes may be freely changed, such that, for example, one of the left and right guiding portions is a protrusion, the other of the left and right guiding portions is a recessed portion; and one of the left and right guide portions is a protrusion and the other of the left and right guide portions is a recessed portion.

(H04) Although, in the exemplary embodiment, it is desirable that the bases 11 be provided below the accommodation space 10, it is not impossible to provide the bases 11 at a central portion or an upper portion of the accommodation space 10. Although the bases 11 are formed on the upper surface of the writing unit 12 that extends in the left-right direction, as with the right guiding wall 21, the bases 11 may protrude from respective left and right sides to allow the process unit PU to be placed thereon.

(H05) Although, in the exemplary embodiment, the structure in which the process unit PU and the toner cartridge TC are separately removable from the printer body U1 is exemplified, other structures may be used. For example, the toner cartridge TC may be built in the process unit PU. In this case, the bases 11 may be disposed at substantially the same height as the left guiding groove 16 and the right guiding wall 21.

(H06) Although, in the exemplary embodiment, the second guide portions are formed as the shafts of the photoconductor PR, the second guide portions are not limited thereto. The second guide portions and the shafts of the photoconductor may be separate portions. For example, the second guide portions may be used as shafts of the developing roller Ga. Similarly, although the first guide portions are provided at a lower surface of the developing container V, the first guide portions may be provided at other portions. For example, the first guide portions may be provided at a lower surface of the photoconductor cleaner CL.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first removable member that includes an image carrying member and that is removably supported with respect to a body of the image forming apparatus;

a first guide portion that is provided at a lower surface of the first removable member;

a second guide portion that is provided at the first removable member;

a first guiding portion that is provided at the body of the image forming apparatus and that supports the first guide portion when the first removable member is placed on the first guiding portion; and a second guiding portion that is provided at the body of the image forming apparatus, in which, when the first removable member moves in a mounting direction from a state in which the first guide portion is supported by the first guiding portion, the second guiding portion contacts the second guide portion and guides the second guide portion.

2. The image forming apparatus according to claim 1, wherein the first guiding portion is displaced from the second guiding portion in a gravitational direction.

3. The image forming apparatus according to claim 1, further comprising:

a second removable member that is disposed downstream in a separation direction from the first removable member and that is removable from the body of the image forming apparatus, the second removable member containing developer therein; and a third guide portion that protrudes outward in a direction that intersects a mounting direction of the second removable member, wherein the second guiding portion guides the third guide portion.

4. The image forming apparatus according to claim 2, further comprising:

a second removable member that is disposed downstream in a separation direction from the first removable member and that is removable from the body of the image forming apparatus, the second removable member containing developer therein; and a third guide portion that protrudes outward in a direction that intersects a mounting direction of the second removable member, wherein the second guiding portion guides the third guide portion.

* * * * *